United States Patent [19]

Graser et al.

[11] 3,997,051

[45] Dec. 14, 1976

[54] ARTICLE CARRIER

[75] Inventors: Earl J. Graser, Monroe, La.; Glen Ray Harrelson, Gulf Breeze, Fla.

[73] Assignee: Olinkraft, Inc., West Monroe, La.

[22] Filed: Oct. 6, 1975

[21] Appl. No.: 620,075

[52] U.S. Cl. ..... 206/173; 206/187

[51] Int. Cl.[2] ..... B65D 75/00

[58] Field of Search ..... 206/170–173, 206/180–191

[56] References Cited

UNITED STATES PATENTS

| | | | |
|---|---|---|---|
| 2,532,446 | 12/1950 | Hall | 206/173 X |
| 2,593,135 | 4/1952 | Gilbert | 206/173 |
| 2,783,916 | 3/1957 | Hodapp | 206/173 X |
| 3,236,414 | 2/1966 | Slevin, Jr. | 206/187 X |
| 3,567,069 | 3/1971 | Harrelson | 206/187 |
| 3,672,539 | 6/1972 | Forrer | 206/173 |
| 3,857,483 | 12/1974 | Wood | 206/187 |
| 3,917,059 | 11/1975 | Wood | 206/187 |

*Primary Examiner*—William Price
*Assistant Examiner*—Stephen Marcus
*Attorney, Agent, or Firm*—O'Brien & Marks

[57] ABSTRACT

A paperboard carrier folded from a blank includes primary and secondary support means for the bottom of the carrier. The primary support includes a pair of end locking tabs fitting into notches in the carrier bottom and the secondary support includes a projection from the center section of the carton with a tab locking into a hole provided in the carton bottom.

2 Claims, 6 Drawing Figures

FIG. 2
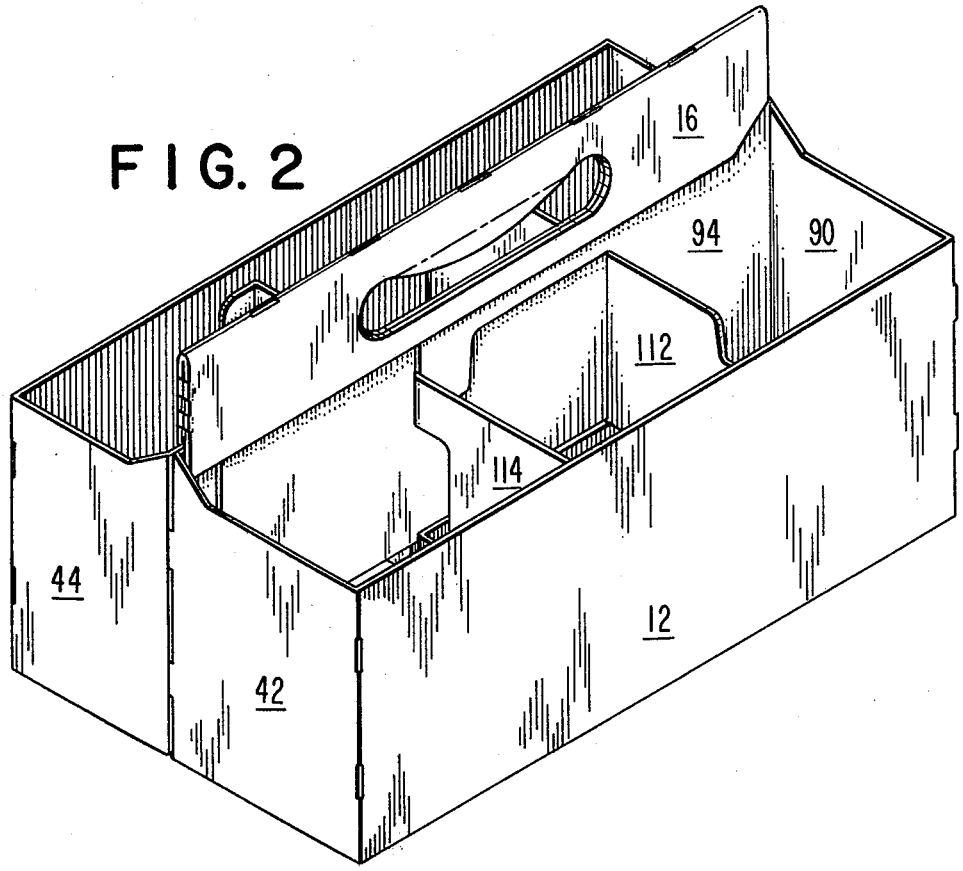
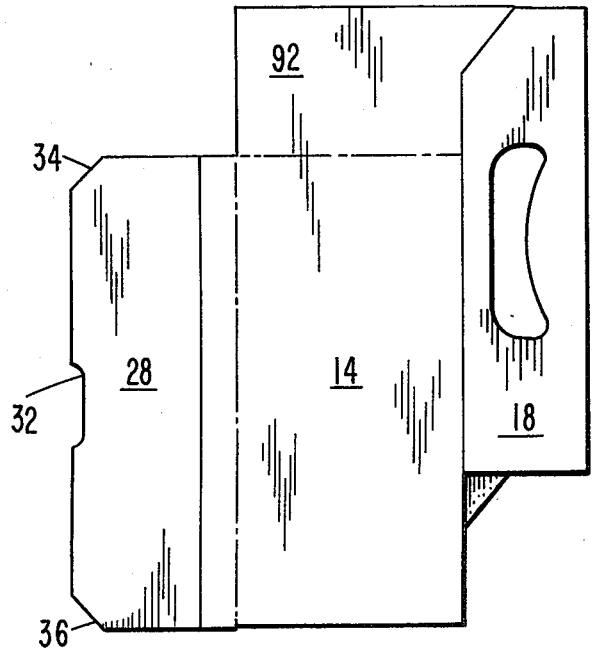
FIG. 5

ARTICLE CARRIER

BACKGROUND OF THE INVENTION

1. Field of the Invention

The present invention relates to article carriers for transporting a plurality of generally cylindrical articles and in particular to such a carrier having a special support feature for maintaining the carton erect and for increasing the strength of the bottom of the carrier so that it may support heavier articles.

2. Description of the Prior Art

The prior art, as exemplified by U.S. Pat. No. 2,593,135, No. 3,288.326, No. 3,568,880, No. 3,572,542 and No. 3,757,991, is generally cognizant of article carriers with locking means to support the ends of the bottom of the carrier. In addition, as is demonstrated by U.S. Pat. No. 2,783,916, No. 3,093,265, No. 3,104,027, and No. 3,140,793, it is known in the art to provide a projection locking into a hole in the carrier bottom. However both of these approaches are insufficient to ensure that the necessary stability of the carrier is maintained because paperboard elements, and locking elements in particular, after often subject to prolonged tension and repeated movements causing then to become worn and pliable and thereby ineffective. The present invention provides a solution for this problem by providing for both primary and secondary locking of the carrier bottom to achieve a redundancy in the carrier support.

SUMMARY OF THE INVENTION

The present invention is summarized in that an article carrier includes a pair of parallel side walls, a pair of end walls joining the ends of the side walls, a center section extending between the end walls parallel to the side walls, a carrier bottom attached to both of the side walls and having formed on both of its ends a locking notch and having a locking hole defined therein, first and second end locking tabs formed on the center section, each projecting into a respective one of the locking notches to serve as primary supports for the carrier bottom, and at least one center locking tab locking into the locking hole to serve as a secondary support for the carrier bottom.

An object of the present invention is to provide a paperboard article carrier in which the carrier bottom has increased support so that it can carry heavier articles.

A further object of this invention is to construct a paperboard article carrier with primary and secondary redundant supports for the carrier bottom to ensure carrier stability after repeated use.

It is an advantage of the present invention in that manufacturing dimensional variations are allowed for the center locking supports so that the carrier can be more economically manufactured.

Further objects and advantages of the present invention will become apparent from the following description of the preferred embodiment when taken in conjunction with the accompanying drawings.

BRIEF DESCRIPTION OF THE DRAWINGS

FIG. 2 is an elevated perspective view of an article carrier according to the present invention.

FIGS. 3, 4, and 5 are plan views of the blank of FIG. 1 in intermediate successive stages of its erection into the carrier of FIG. 2.

DESCRIPTION OF THE PREFERRED EMBODIMENT

Figure 1:
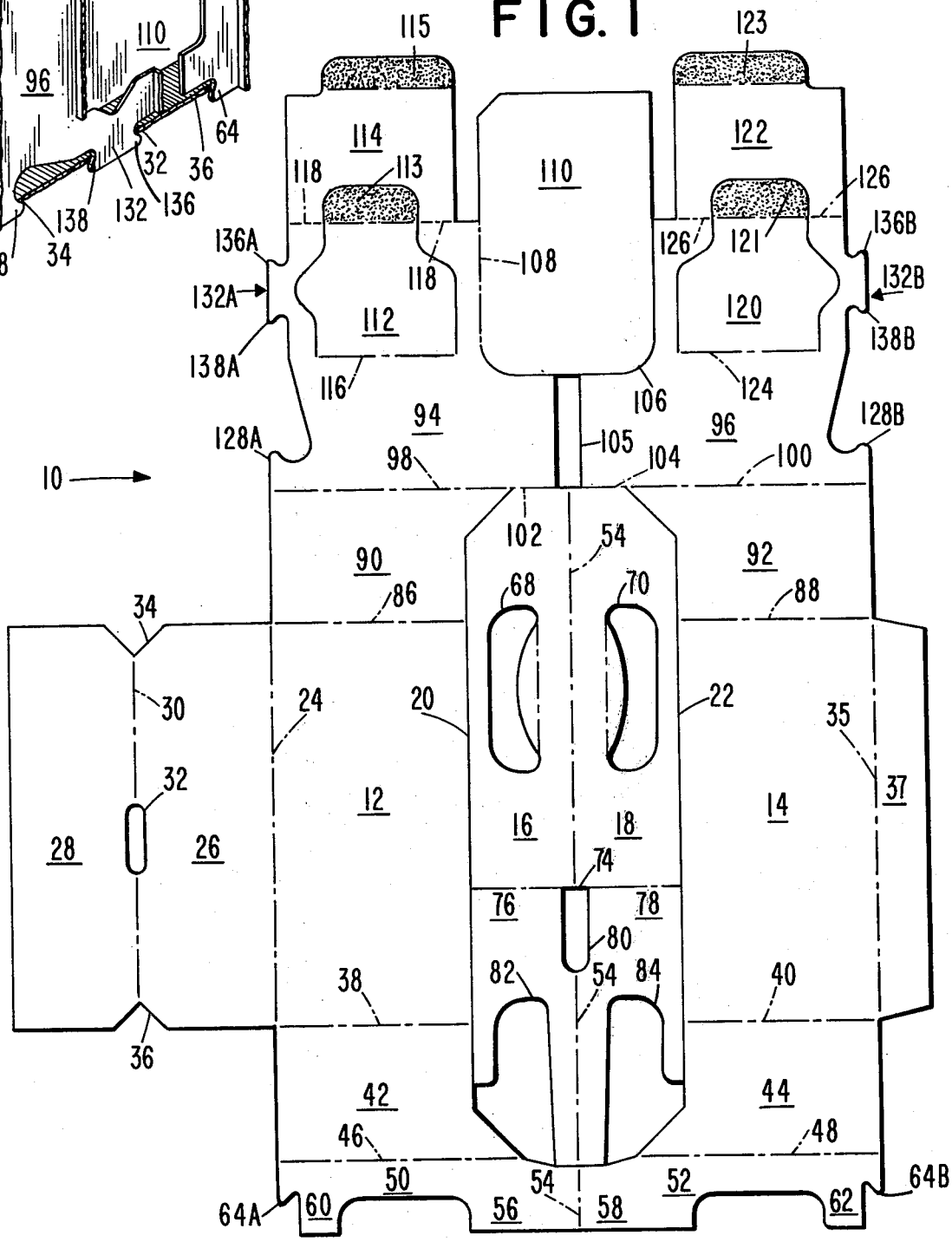
FIG. 1 is a plan view of a paperboard blank from which the carrier of the present invention is erected.

Shown in FIG. 1 is a paperboard blank 10 from which a basket carrier constructed according to the present invention is folded. The blank 10 includes a first side panel 12 and a second side panel 14 between which are formed first and second handle panels 16 and 18 separated from the side panels 12 and 14 by respective die cuts 20 and 22. Extending from the first side panel 12 and separated therefrom by a score line 24 is a first bottom panel 26 to which in turn is connected a second bottom panel 28. The bottom panels 26 and 28 are separated by a score line 30 along which is formed a locking hole 32 defined by a cut-out in the blank 10. At the ends of the score line 30 and cut into the inside corners of the first and second bottom panels 26 and 28 are first and second V-shaped locking notches 34 and 36. Extending from the side panel 14 and separated therefrom by a score line 35 is a bottom gluing panel 37.

Attached to one side of the first and second side panels 12 and 14 by score lines 38 and 40 are respective first end panels 42 and 44. Extending in turn from the end panels 42 and 44 and separated from them by score lines 46 and 48 are riser gluing panels 50 and 52. The riser gluing panels 50 and 52 are joined at their adjacent edges by a center score line 54. The riser gluing panels 50 and 52 include first glue tabs 56 and 58 adjacent the center score line 54 and also second glue tabs 60 and 62. Formed along the edge of the riser gluing panel 50 is a first element **64*a* of a first end locking tab and formed on the riser gluing panel 52 is a second element 64*b*** of the first end locking tab.

Each of the handle panels 16 and 18 formed between the die cuts 20 and 22 has defined therein a cut-out forming a respective handle openings 68 and 70. The handle panels 16 and 18 are joined at their center by an extension of the center score line 54. The center line 54 also extends between and connects a pair of handle reinforcing panels 76 and 78. The handle reinforcing panels 76 and 78 are joined in the respective handle panels 16 and 18 by a score line 74. Formed along the center score line 54 and between the handle reinforcing panels 76 and 78 is a cut-out 80. In addition, handle openings 82 and 84 are provided by die cuts in the edge of the handle reinforcing panels 76 and 78.

Extending from the edge of the side panels 12 and 14 opposite of the end panels 42 and 44 are a pair of second end panels 90 and 92. The end panels 90 and 92 are joined to the side panels 12 nd 14 by respective score lines 86 and 88. Extending from the end panels 90 and 92 are riser panels 94 and 96 joined to the end panels 90 and 92 by score lines 98 and 100 and also joined to the handle panels 16 and 18 by score lines 102 and 104. A rectangular cut out 105 is formed by die cuts between the riser panels 74 and 76. Separated from the riser panel 96 by a die cut 106 and attached to the riser panel 94 by a score line 108 is a riser bridging panel 110. Formed from a riser panel 94 and attached to it by score lines 116 and 118 are respective partitioning panels 112 and 114 which have at their edges respective gluing tabs 113 and 115. Similarly formed in the riser panel 96 are partitioning panels 120 and 122 joined to the riser panel by score lines 124 and 126, the partitionng panels 120 and 122 having at their extreme ends respective gluing tabs 121 and 123. Formed on the edge of the riser panel 94 is an element 128a of a second end locking tab and a projection element 132a of a center locking projection. On the edges of the projection element **132*a* are formed elements 136a and 138*a* of first and second center locking tabs. Formed on the edge of the riser panel 96 is an element 128*b* of the second end locking tab and also an element 132*b* of the center locking projection having formed on its edges elements 136*b* and 138*b*** of the first and second center locking tabs.

Figure 3:
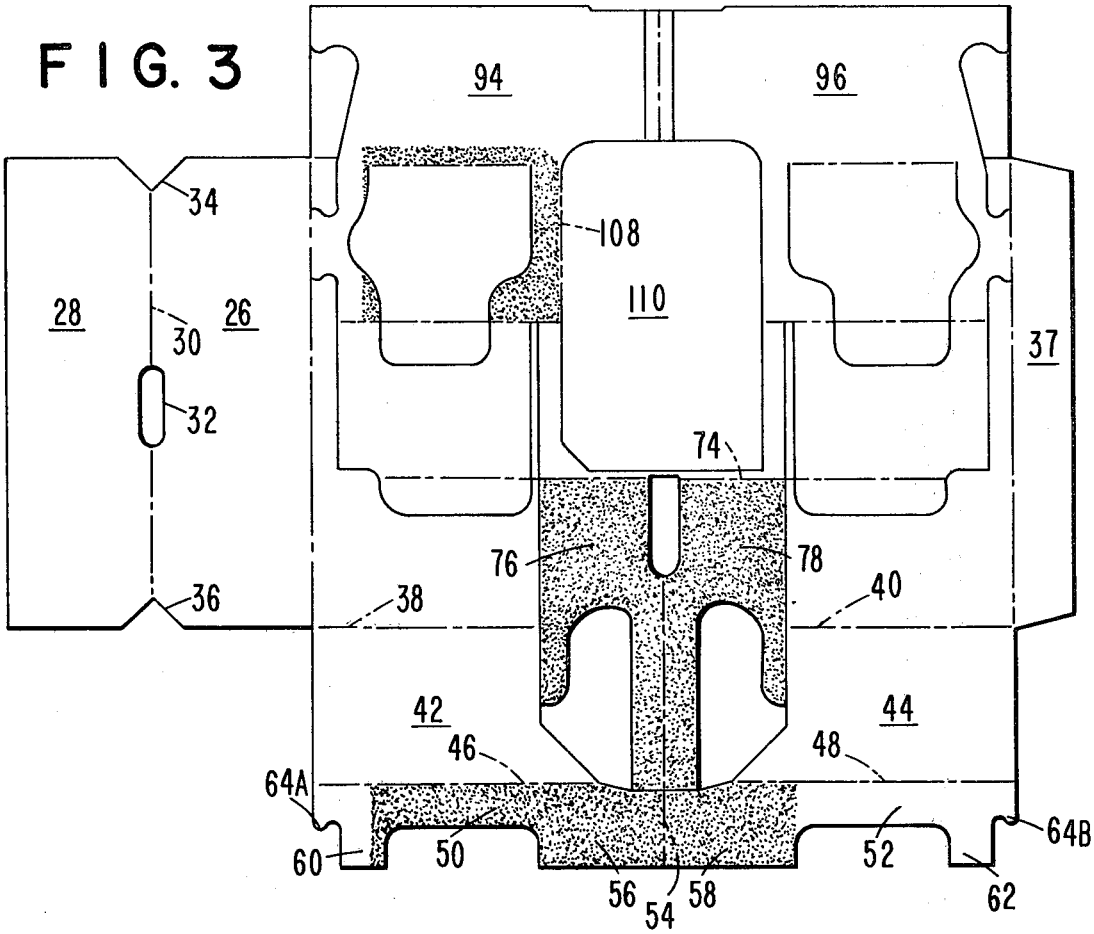
Figure 4:
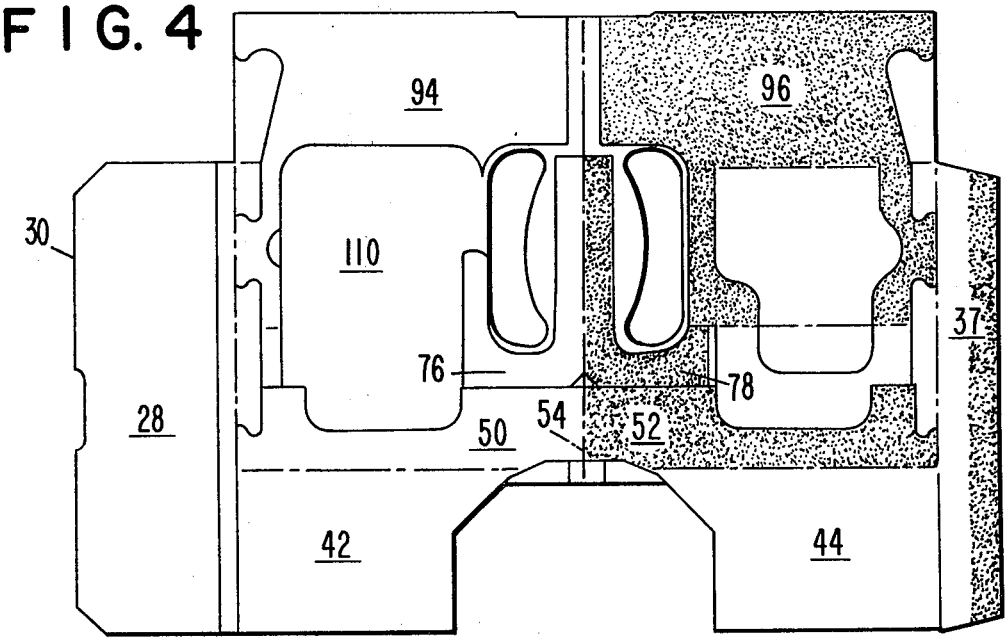

The blank 10 of FIG. 1 can be erected into an erected carrier as shown in FIG. 2 through a gluing and folding sequence as shown in FIGS. 3–5. In referring to these drawings it should be noted that those portions of the blank which are coated with glue or other adhesive during erection of the carrier are shown as being stippled.

As is shown in FIG. 1, to start the erection of the carrier glue is applied to the gluing tabs 113, 115 121 and 123 of the partitioning panels 112, 114, 120 and 122. A folding sequence begins with the folding down of the riser panels 96 and 94 along the score lines 98, 100, 102 and 104 into the position shown in FIG. 3. This secures the gluing tabs 113 and 115 to the side panel 12 and the gluing tabs 121 and 123 to the side panel 14. Following this, as shown in FIG. 3, glue is applied to the handle reinforcing panels 76 and 78, to a small area on the riser panel 94 and also to the gluing tabs 60 and 56 on the riser panel 50 and to the gluing tab 58 of the riser panel 52. The folding sequence in going from FIG. 3 to FIG. 4 starts with the folding of the riser bridging panel 110 along the score line 108 over into the glued area on the riser panel 94 adhering it thereto. The handle reinforcing panels 76 and 78 are then folded upward along the score line 74 and are pressed onto the handle panels 16 and 18 which were exposed after the riser bridging panel 110 was folded. Following this, the end panels 42 and 44 together with the riser panels 50 and 52 are folded upward as a unit along the colinear score lines 38 and 40 onto the handle reinforcing panels 76 and 78. The riser panel 52 secures to the handle reinforcing panel 78 while the riser panel 50 secures to both the handle reinforcing panel 76 and also the riser bridging panel 110. Also as shown in FIG. 4 the bottom panel 28 is folded over along the score line 30 onto the bottom panel 26 but no glue is applied to either panel.

As is shown in FIG. 4, glue is next applied to the exposed side of the riser panel 52, to the exposed area of the handle reinforcing panel 78 and to the riser panel 96. In addition, glue is also applied to the edge area of the bottom gluing panel 37. Then the blank 10 is folded over along its center score line 54 to form the flattened carrier of FIG. 5. At this time the riser panels 50 and 52 secure together as do the handle reinforcing panels 76 and 78 and the riser panels 94 and 96. In addition the bottom gluing panel 37 secures to the bottom panel 28. By joining the elements 64a and 64b together as the riser panels 50 and 52 are secured to each other, there is formed a double thickness end locking tab 64. Similarly as the riser panels 94 and 96 are secured to each other, the elements **128*a* and 128*b* form a second end locking tab 128. Also, the elements 132*a* and 132*b* are adhered to each other to form a locking projecting 132 having on its opposite edges two center locking tabs 136 and 138 formed from the elements 136*a*, 136*b*, 138*a* and 138*b***.

The completed carrier of FIG. 5 can then be erected in a conventional manner by pulling the side panels 12 and 14 away from the center section of the carrier. This pulls the end panels 90 and 92 and 42 and 44 into a perpendicular position between the riser panels and the side panels 12 and 14. In addition, the bottom panels 28 and 26 are unfolded bridging the bottom of the carrier and forming a carrier bottom between the side panels 14 and 12. The partitioning panels 112, 114, 120 and 122 are also folded to a perpendicular position extending from the center section of the carrier out to the respective side panels 12 and 14. The center section of the carrier is formed by the riser bridging panel 110 which has at its opposite ends the glued together riser panels 50 and 52 and the glued together riser panels 94 and 96. Extending up above the riser bridging panel 110 and attached to both it and the riser panels 50 and 52 and 94 and 96 is the handle formed by the handle panels 16 and 18.

Figure 6:
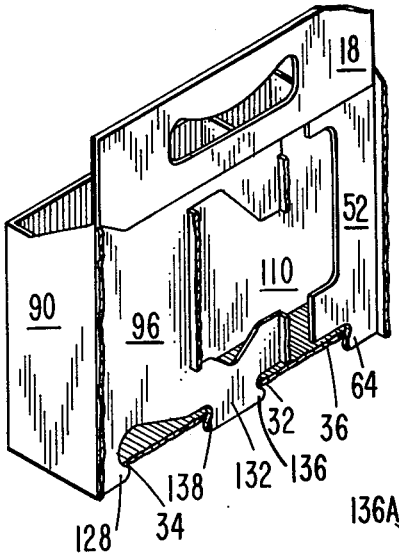
FIG. 6 is an isometric view of the carrier of FIG. 2, with parts removed.

To secure the carrier in the erected position and to allow it to carry articles in the pockets formed between the partitioning panels, the carrier bottom must be supported. This support feature is shown best in FIG. 6 As the side panels 12 and 14 are pulled away from the center of the carrier, the bottom panels 26 and 28 of the carrier bottom are brought upward to the lock the bottom of the carrier in place. End locking notch 34 is brought upward and is inserted above and locked in place by the end locking tab 128 depending from the center section of the carrier. At the same time, the locking projection 132 is inserted into the locking hole 32 and the end locking tab 64 is inserted into the end locking notch 36. The locking of the locking notches 34 and 36 above the end locking tabs 128 and 64 serves as a primary support to the bottom panels 26 and 28 of the carrier. The center locking tabs 136 and 138 serve as a secondary support in case of failure of either of the locking tabs at either end of the carrier. It should be apparent that if the locking projection 132 is sized so as to be of a small enough dimension so as to easily fit through the locking hole 32 without bending, both of the locking tabs 136 and 138 cannot simultaneously engage opposite ends of the locking hole 32. Therefore, one or the other of the locking tabs 136 and 138 will always be unengaged. However, insomuch as there is a certain dimensional variation of each individual carton in a large production run, it is advantageous for locking tabs to be provided on both sides of the locking projection 132 in order that it will be insured that one or the other of the locking tabs 136 and 138 will secure to the edge of the locking hole 32 to serve a secondary support function for the bottom end of the carton. By locking the bottom of the carton in place, the locking tabs not only strengthen the carrying capacity of the carton by keeping the bottom of the carrier in place, but also serve to maintain the erected carrier in its erected state at all times, inasmuch as it is necessary for the bottom panels 26 and 28 to fold outward along the score line 30 for the carton to be recollapsed into its position shown in FIG. 5.

Inasmuch as the present invention is subject to many variations, modifications and changes in minor detail, it is intended that all matter in the above specification or the accompanying drawings be interpreted in an illustrative rather than in a limiting sense.

What is claimed is:

1. A paperboard article carrier comprising
a pair of parallel side walls,
a pair of end walls joining the ends of the side walls,
a center section extending between the end walls parallel to the side walls,
a carrier bottom attached to both of the side walls, and having formed on both of its ends a locking notch and having a locking hole defined therein,
first and second end locking tabs formed on the center section each projecting into a respective one of the locking notches to serve as primary supports for the carrier bottom, and
a locking projection depending from the center section and having formed thereon two center locking tabs, the locking projection locking into the locking hole to serve as a secondary support for the carrier bottom, only one of the locking tabs at a time locking onto the edge of the locking hole.

2. An article carrier comprising
a handle formed from a pair of glued together handle panels, and having two ends,
a center section including a pair of glued together riser panels at each end of the handle and depending therefrom and including a riser bridging panel connecting the pair of riser panels,
an end panel hingedly attached to each riser panel, the pair of end panels at each end of the carrier section extending outwardly in opposite direction from the center section, a side panel on each side of, and parallel to, the center section and each hingedly joined at each of its ends to one of the end panels,
a pair of partitioning panels on each side of the center section and extending outwardly from the center section to the side panels,
a carrier bottom including a pair of bottom panels each hingedly attached to one of the side panels, the bottom panels being joined by a score line, the carrier bottom having a V-shaped locking notch defined in each end thereof along the scoreline and having an elongated center locking hole defined in the center thereof between the bottom panels and along the scoreline,
a first and second locking tabs formed of bonded together tab elements and extending downward from the riser panels at opposite ends of the center section, the locking tabs locking with the locking notches in the carrier bottom to serve as primary supports for the carrier bottom, and
a locking projection formed of bonded together projection elements and extending downward from the center section to project through the locking hole in the carrier bottom, the locking projection having oppositely extending center locking tabs only one of which engages an edge of the locking hole to serve as a secondary support for the carrier bottom.

* * * * *